US011455966B2

(12) United States Patent
Qiu

(10) Patent No.: US 11,455,966 B2
(45) Date of Patent: Sep. 27, 2022

(54) CORRECTION METHOD FOR DISPLAY PANEL AND DISPLAY DEVICE

(71) Applicant: HKC CORPORATION LIMITED, Shenzhen (CN)

(72) Inventor: Bin Qiu, Shenzhen (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 17/276,828

(22) PCT Filed: Jan. 9, 2019

(86) PCT No.: PCT/CN2019/070990
§ 371 (c)(1),
(2) Date: Mar. 17, 2021

(87) PCT Pub. No.: WO2020/133577
PCT Pub. Date: Jul. 2, 2020

(65) Prior Publication Data

US 2021/0264865 A1 Aug. 26, 2021

(30) Foreign Application Priority Data

Dec. 25, 2018 (CN) ..... 201811589921.0

(51) Int. Cl.
*G09G 3/36* (2006.01)
*G09G 3/3208* (2016.01)
*G09G 3/20* (2006.01)

(52) U.S. Cl.
CPC ..... *G09G 3/3607* (2013.01); *G09G 3/3208* (2013.01); *G09G 3/2003* (2013.01);
(Continued)

(58) Field of Classification Search
CPC ..... G09G 3/3696; G09G 2320/0247; G09G 2320/0693; G09G 3/3607; G09G 3/3208;
(Continued)

(56) References Cited

U.S. PATENT DOCUMENTS 7,636,487 B2 * 12/2009 Lee ..... G09G 3/2044 358/463
8,564,518 B2 * 10/2013 Nakahata ..... G09G 3/3648 345/89

(Continued)

FOREIGN PATENT DOCUMENTS

CN 104021751 A 9/2014
CN 105529008 A 4/2016

(Continued)

OTHER PUBLICATIONS

Songjiang Wu, the International Searching Authority written comments, Sep. 2019, CN.

(Continued)

*Primary Examiner* — Michael J Jansen, II

(57) ABSTRACT

The present application relates to a correction method for a display panel and a display device, including: after dividing a common electrode layer of a display panel into at least one region, applying corresponding initial voltage to each region and measuring the initial voltages; and then according to a preset voltage, firstly coarsely adjusting the initial voltage of a color shift region, and then finely adjusting a data voltage of a sub-pixel corresponding to each sub-pixel in the color shift region.

14 Claims, 3 Drawing Sheets

(52) U.S. Cl.
CPC ..... *G09G 3/2007* (2013.01); *G09G 2310/08* (2013.01); *G09G 2320/0242* (2013.01)

(58) Field of Classification Search
CPC ..... G09G 3/2003; G09G 3/2007; G09G 2310/08; G09G 2320/0242
See application file for complete search history.

(56) References Cited

U.S. PATENT DOCUMENTS

| | | | | |
|---|---|---|---|---|
| 9,472,158 | B2 * | 10/2016 | Lin | G09G 3/3648 |
| 9,489,911 | B2 * | 11/2016 | Aoki | G09G 3/3685 |
| 9,995,952 | B2 * | 6/2018 | Chen | G09G 3/3622 |
| 10,013,929 | B2 * | 7/2018 | Du | G09G 3/3655 |
| 10,741,137 | B2 * | 8/2020 | Bai | G09G 3/3688 |
| 2006/0087696 | A1 * | 4/2006 | Lee | H04N 1/603 358/3.23 |
| 2011/0096058 | A1 * | 4/2011 | Nakahata | G09G 3/3648 345/212 |
| 2015/0015619 | A1 * | 1/2015 | Aoki | G09G 3/3696 345/690 |
| 2016/0275899 | A1 * | 9/2016 | Lin | G09G 3/3696 |
| 2016/0358562 | A1 * | 12/2016 | Du | G09G 3/3655 |
| 2018/0059458 | A1 * | 3/2018 | Chen | G02F 1/133308 |
| 2018/0254011 | A1 * | 9/2018 | Du | G02F 1/1368 |
| 2019/0073971 | A1 * | 3/2019 | Bai | G09G 3/3648 |
| 2019/0108803 | A1 * | 4/2019 | Wang | G09G 3/3685 |

FOREIGN PATENT DOCUMENTS

| | | | |
|---|---|---|---|
| CN | 105632450 | A | 6/2016 |
| CN | 105741812 | A | 7/2016 |
| JP | 2009229966 | A | 10/2009 |
| TW | 200802237 | A | 1/2008 |

OTHER PUBLICATIONS

Songjiang Wu, the International Searching Report, dated Sep. 2019, CN.

* cited by examiner

CORRECTION METHOD FOR DISPLAY PANEL AND DISPLAY DEVICE

CROSS REFERENCE OF RELATED APPLICATIONS

This application claims the priority to the Chinese Patent Application No. 201811589921.0, filed with National Intellectual Property Administration, PRC on Dec. 25, 2018 and entitled "CORRECTION METHOD FOR DISPLAY PANEL AND DISPLAY DEVICE", which is incorporated herein by reference in its entirety.

TECHNICAL FIELD

The present application relates to the field of display, particularly to a correction method for a display panel and a display device.

BACKGROUND

The statements herein merely provide background information related to the present application and may not necessarily constitute related art.

Thin Film Transistor Liquid Crystal Display (TFT-LCD) has the characteristics of light weight, flat-panel appearance, low power consumption, no radiation, excellent display quality and the like, and the application field thereof is gradually expanded. The liquid crystal capacitor, the energy storage capacitor and the parasitic capacitor between gate and source of the Thin Film Transistor (TFT) in a pixel unit of the TFT-LCD reach a charge conservation state when the TFT is in an off-state. There is a capacitance coupling effect in the circuit, and a data voltage of a pixel pulls the voltage of a common electrode, causing the voltage of the common electrode deviates from a preset initial value, further causing a voltage difference value between two ends of other pixel electrodes deviates from a preset value, so that the displayed brightness is poor, and the phenomenon that some sub-pixels are relatively bright is generated, thereby affecting the image quality.

SUMMARY

According to various embodiments of the present application, there is provided a correction method for a display panel, the method includes:

dividing a common electrode layer of the display panel into at least one region;

applying a corresponding initial voltage to the common electrode layer of each region of the display panel, and measuring the initial voltages;

comparing each of first deviation values with a preset deviation value, the first deviation values are the difference between each of the initial voltages from a preset voltage;

taking a region corresponding to the first deviation value as a color shift region, when the first deviation value is larger than the preset deviation value;

adjusting the initial voltage of the color shift region, so that the initial voltage of the color shill region is equal to the preset voltage;

determining a gray-scale compensation value according to a sub-pixel voltage corresponding to each sub-pixel in the color shift region and the preset voltage; and compensating the data voltage of the sub-pixel in the color shift region according to the gray-scale compensation value.

A correction method fora display panel, includes:

dividing a common electrode layer of the display panel into at least one region;

applying a corresponding initial voltage to the common electrode layer of each region of the display panel, and measuring the initial voltage in each region;

comparing each of first deviation values with a preset deviation value, the first deviation values are the difference between each of the initial voltages from a preset voltage;

the display panel displays normally when the first deviation value is smaller than the preset deviation value;

taking a region corresponding to the first deviation value as a color shift region, when the first deviation value is larger than the preset deviation value;

adjusting the initial voltage of the color shift region, so that initial voltage of the color shift region is equal to the preset voltage;

determining the gray-scale compensation value according to a sub-pixel voltage corresponding to each sub-pixel in the color shift region and the preset voltage; and compensating the data voltage of the sub-pixel in the color shift region according to the gray-scale compensation value.

A display device, includes:

a display panel for displaying images;

a display control module electrically connected to the display panel, the display control module includes a timing controller including a storage unit, a processing unit and a computer program stored on the storage unit and operable on the processing unit, the program, when executed by the processing unit, implements the steps of:

dividing a common electrode layer of the display panel into at least region;

applying a corresponding initial voltage to the common electrode layer of each region of the display panel, and measuring the initial voltages;

comparing each of first deviation values with a preset deviation value, the first deviation values are the difference between each of the initial voltages from a preset voltage;

taking a region corresponding to the first deviation value as a color shift region, when the first deviation value is larger than the preset deviation value;

adjusting the initial voltage of the color shift region, so that the initial voltage of the color shift region is equal to the preset voltage;

determining a gray-scale compensation value according to a sub-pixel voltage corresponding to each sub-pixel in the color shift region and the preset voltage; and compensating the data voltage of the sub-pixel in the color shift region according to the gray-scale compensation value.

The details of one or more embodiments of the present application are set forth in the accompanying drawings and the description below. Other features, objects and advantages of the present application will be apparent from the specification, drawings and claims.

BRIEF DESCRIPTION OF DRAWINGS

For a better understanding of the embodiments or examples of those applications disclosed herein, reference may be made to one or more of the drawings. The additional details or examples used to describe the drawings should not be considered limiting the scope of the disclosed applications, the presently described embodiments or examples, and any of the presently understood best modes of carrying out these applications.

DETAILED DESCRIPTION OF EMBODIMENTS

In order to make the objects, technical solutions and advantages of the present application more clearly understood, the present application is further described in detail below with reference to the drawings and embodiments. It should be understood that the specific embodiments described herein are only for explaining, but not for limiting the present application.

It should be noted that when an element is referred to as being "disposed on" another element, it can be directly on another element or an intervening element may also be present. When an element is referred to as being "connected" to another element, it can be directly connected to another element or an intervening element may also be present. The terms "vertical," "horizontal," "left," "right," and the like as used herein are for illustration proposes only and do not represent the only embodiment.

Unless defined otherwise, all technical and scientific terms used herein have the identical meaning as commonly understood by one of ordinary skill in the art to which the present application belongs. The term used in the specification of the present application herein is for the purpose of describing particular embodiment only and is not intended to be limiting of the present application. All possible combinations of the technical features in the embodiments described above may not be described for the sake of brevity, but should be considered as being within the scope of the present disclosure as long as there is no contradiction between the combinations of the technical features.

Figure 1:
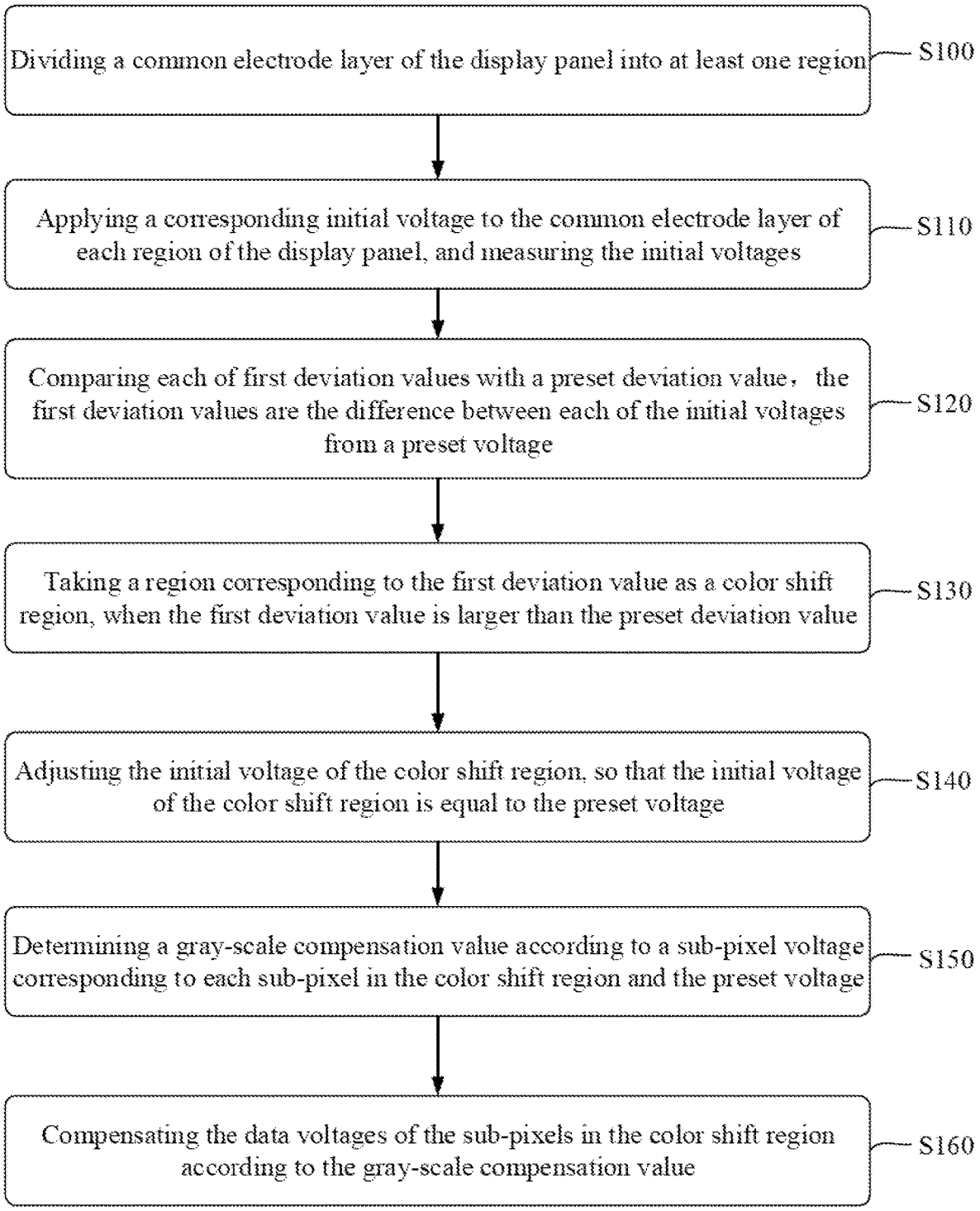
FIG. 1 is a flowchart of a correction method for a display panel according, to an embodiment of the present application.

Referring to FIG. 1, a correction method for a display panel is provided in one or more embodiment of the present application, including the following steps:

S100: Dividing a common electrode layer of the display panel into at least one region.

Specifically, the common electrode layer of the display panel is divided into at least one region, and each region is applied for a voltage. Optionally, the common electrode layer of the display panel is divided into 9 regions that are arranged in an array, and a corresponding initial voltage is applied to each of the regions. In other embodiments, other dividing manners may also be adopted to divide the regions of the display panel, and it can be understood that the more divided regions, the compensated display effect is well.

S110: Applying a corresponding initial voltage to the common electrode layer of each region of the display panel, and measuring the initial voltages.

Specifically, the initial voltage is the common voltage of each of the regions. The applied initial voltages may be the identical or different, and in the present embodiment, the identical initial voltage is applied. The initial voltage of each region is measured by the timing controller.

S120: Comparing each of first deviation values with a preset deviation value, the first deviation values are the difference between each of the initial voltages from a preset voltage;

S130: taking a region corresponding to the first deviation value as a color shift region, when the first deviation value is larger than the preset deviation value;

S140: adjusting the initial voltage of the color shift region, so that the initial voltage of the color shift region is equal to the preset voltage.

Specifically, the preset voltage is the voltage of the common electrode layer when the display panel normally displays. The initial voltage of each region is subtracted from the preset voltage to obtain a plurality of corresponding first deviation values. The first deviation value is compared with the preset deviation value, when at least one first deviation value is larger than the preset deviation value, a color shift may occur in the region corresponding to the first deviation value, and the region corresponding to the first deviation value larger than the preset deviation value is taken as a color shift region. The color shift region is a region to be compensated. And the initial voltage of the color shift region is adjusted to enable the initial voltage of the color shift region to be equal to the preset voltage. In other regions, no compensation is performed when the first deviation value is smaller than the preset deviation value.

S150: Determining a gray-scale compensation value according to a sub-pixel voltage corresponding to each sub-pixel in the color shift region and the preset voltage.

Specifically, in the present embodiment, the sub-pixel voltage of each sub-pixel in the color shift region may be measured by the timing controller, and then the second deviation value between the voltage of each sub-pixel and the preset voltage is calculated, and the gray-scale compensation value corresponding to each sub-pixel is obtained to compensate the sub-pixels in the color shift regions since the second deviation values respectively corresponding to the gray-scale compensations.

S160: Compensating the data voltages of the sub-pixels in the color shift region according to the gray-scale compensation value.

Specifically, the data voltage of each sub-pixel in the color shift region is compensated after the gray-scale compensation value of each sub-pixel in the color shift region is obtained, and the gray-scale compensation value is added to the initial data voltage of the sub-pixel to obtain a compensated data voltage input to the corresponding sub-pixel.

According to the correction method for a display panel, the color shift region is determined by dividing the display panel into regions, followed by coarsely adjusting the initial voltage of the color shift region, then the second deviation value of the sub-pixel voltage of each sub-pixel in the color shift region from the preset voltage is measured, and the data voltage of each sub-pixel is compensated according to the second deviation value look up table, thereby counteracting the pulling of the data voltage to the public voltage and improving the color shift caused by the deviation of the common voltage. Meanwhile, the amplitude of data compensation that needs to be adjusted can be reduced by first coarsely adjusting the initial voltage of the color shift region and then the data voltages of the sub-pixels in the color shift region are finely adjusted, thereby reducing the power consumption of the display panel.

Further, after comparing a first deviation value of each of the initial voltages from a preset voltage with the preset deviation value, the display panel displays normally when the first deviation value of each region is smaller than the preset deviation value. Or the initial voltage of each region can be adjusted to be the identical when the first deviation value of each region is smaller than the preset deviation value, and then the display panel displays normally. Adjusting the initial voltage of each region to be the identical can improve the light emitting uniformity of the display panel.

In one or more embodiments, before the step of determining the second deviation value of the sub-pixel voltage corresponding to each sub-pixel in the color shift region from the preset voltage, the method further includes the steps of: obtaining a gray-scale compensation table, where the gray-scale compensation table includes a mapping relation between the second deviation values and the gray-scale compensation values. Since the data voltages of the sub-pixels have positive and negative polarities, the gray-scale compensation values also have positive and negative polarities. When the second deviation value is positive polarity, the gray-scale compensation value is also positive polarity, and when the second deviation value is negative polarity, the gray-scale compensation value is also negative polarity. In the present embodiment, the gray-scale compensation table may be pre-stored in the timing controller. In other embodiments, the gray-scale compensation table may also be stored in the external memory.

In the correction method for a display panel provided by the embodiment described above, the uneven pulling of the data voltage to a third gray-scale voltage can be counteracted and thus improving the color shift of the display panel by: pre-storing the gray-scale compensation table in the timing controller, looking the table up to obtain the data voltage corresponding to each sub-pixel that needs to be compensated, and then compensating the sub-pixels.

Figure 2:
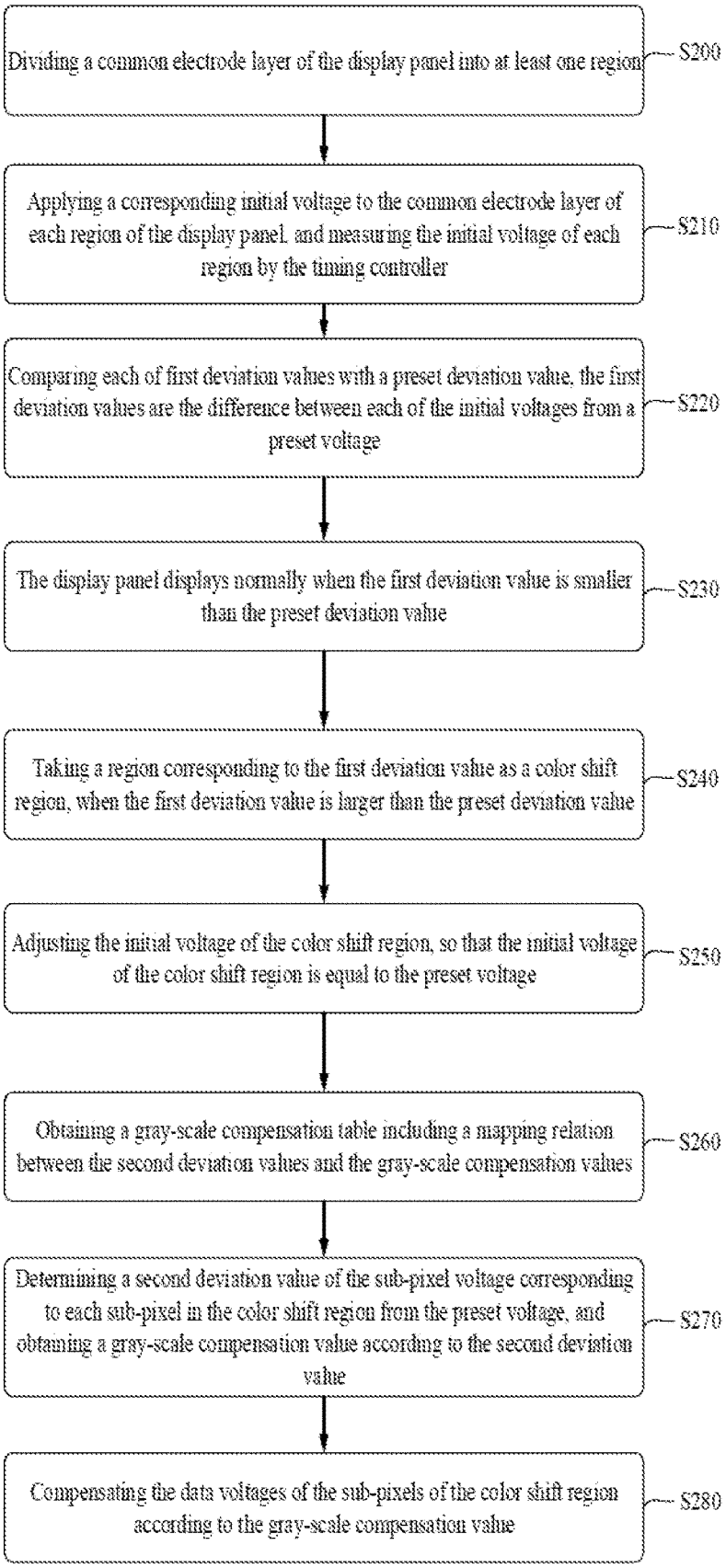
FIG. 2 is a flowchart of a correction method for a display panel according to one particular embodiment of the present application.

Referring to FIG. 2, a correction method for a display panel according to one particular embodiment of the present application is described as follows:

S200: Dividing a common electrode layer of the display panel into at least one region.

Specifically, in the present embodiment, the common electrode layer of the display panel is divided into 9 regions that are arranged in an array. An initial voltage is applied to the common electrode layer of each region.

S210: Applying a corresponding initial voltage to the common electrode layer of each region of the display panel, and measuring the initial voltage of each region by the timing controller.

Specifically, the initial voltage corresponding to the common electrode layer in each region may be the identical or different.

S220: Comparing each of first deviation values with a preset deviation value, the first deviation values are the difference between each of the initial voltages from a preset voltage;

S230: the display panel displays normally when the first deviation value is smaller than the preset deviation value.

In the present embodiment, the preset voltage is the common voltage value when the display panel normally displays. The preset deviation value is a fluctuation range value of the common voltage when the display panel normally displays. When the common voltage fluctuates within this range, the luminance uniformity of each region of the display panel is high.

When the first deviation value is smaller than the preset deviation value, the display panel displays normally. Further, when the first deviation value is smaller than the preset deviation value, the identical voltage can be applied to each region to improve the light emitting uniformity of the display panel.

S240: Taking a region corresponding to the first deviation value as a color shift region, when the first deviation value is larger than the preset deviation value;

S250: adjusting the initial voltage of the color shift region, so that the initial voltage of the color shift region is equal to the preset voltage.

Specifically, the initial voltage of each color shift region is compared with the preset voltage, and the difference value between the preset voltage and the initial voltage is determined when the first deviation value is greater than the preset deviation value. The initial voltage of the color shift region is compensated according to the difference value so as to enable the initial voltage of each color shift region to reach the preset voltage.

S260: Obtaining a gray-scale compensation table including a mapping relation between the second deviation values and the gray-scale compensation values. Where the second deviation value is the difference value between a sub-pixel voltage corresponding to each sub-pixel in the color shift region and the preset voltage.

Specifically, the gray-scale compensation table may be pre-stored in the timing controller. The gray-scale compensation table includes a mapping relation between the second deviation values and the gray-scale compensation values. Since the data voltages of the sub-pixels have positive and negative polarities, the gray-scale compensation values also have positive and negative polarities. When the second deviation value is positive polarity, the gray-scale compensation value is also positive polarity, and when the second deviation value is negative polarity, the gray-scale compensation value is also negative polarity.

S270: Determining a second deviation value of the sub-pixel voltage corresponding to each sub-pixel in the color shift region from the preset voltage, and obtaining a gray-scale compensation value according to the second deviation value.

Since the initial voltage of each region has been coarsely adjusted in step S240 and step S250, in this step, the second deviation value between the sub-pixel voltage and the preset voltage is small, which can reduce the amplitude required to be adjusted and reduce the power consumption of the display panel.

S280: Compensating the data voltages of the sub-pixels of the color shift region according to the gray-scale compensation value.

After obtaining the gray-scale compensation value, the initial data voltage of the sub-pixel in the color shift region is added into the gray-scale compensation value to obtain the compensated data voltage, and the compensated data voltage is input into the corresponding sub-pixel to enable the data compensation of the sub-pixel.

According to the correction method for a display panel, the initial voltage of each of the color shift regions of the display panel is coarsely adjusted by dividing the display panel into regions, followed by measuring the second deviation value of the sub-pixel voltage of each sub-pixel in each of the color shift regions from the preset voltage, and the data voltage of each sub-pixel is compensated according to the second deviation value look up table, thereby counteracting the pulling of the data voltage to the public voltage and improving the color shift caused by the deviation of the common voltage. Meanwhile, the amplitude of data compensation that needs to be adjusted can be reduced by first coarsely adjusting the initial voltage and then finely adjusting the data Voltages of the sub-pixels, thereby reducing the power consumption of the display panel.

It should be understood that although the various steps in the flowcharts of FIGS. 1 to 2 are shown in order as indicated by the arrows, the steps are not necessarily performed in order as indicated by the arrows. The steps are not performed in the exact order shown and may be performed in other orders unless otherwise indicated herein. Also, at least a portion of the steps in FIGS. 1 to 2 may include multiple sub-steps or multiple stages that are not necessarily performed at the identical time, but may be performed at different times, in a sequence that is not necessarily sequential, and may be performed in turn or alternately with other steps or at least some of the sub-steps or stages of other steps.

Figure 3:
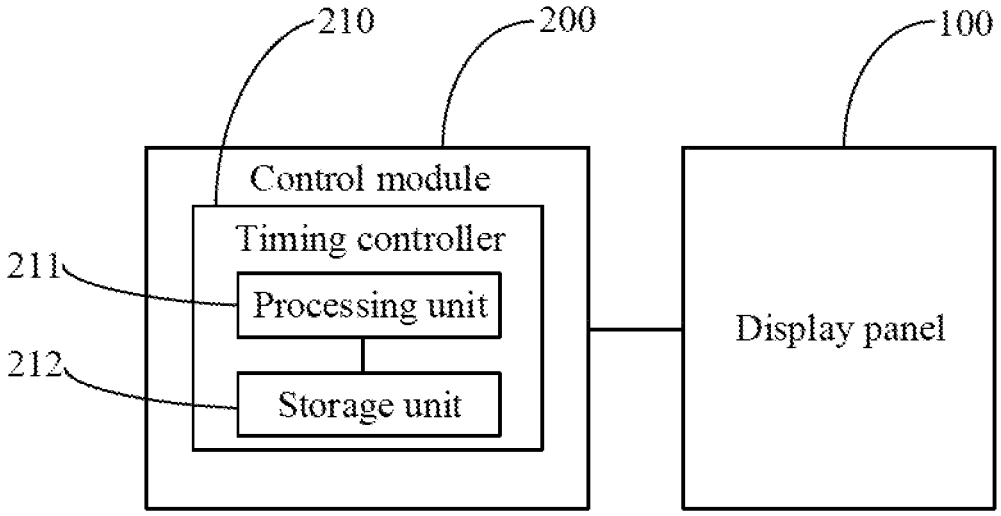
FIG. 3 is a schematic diagram of a display device according to an embodiment of the present application.

Referring to FIG. 3, a display device is provided in one of more embodiments of the present application, including a display panel 100 and a display control module 200. The display control module 200 may control the display of the display panel 100. The display control module 200 includes a timing controller 210. The timing controller 210 includes a processing unit 211 and a storage unit 212. The storage unit 212 is configured to store a computer program corresponding to the above method, and the processing unit 211 is configured to process steps of the above method.

Specifically, the common electrode layer of the display panel 100 has a plurality of regions. The timing controller 210 is configured to input corresponding initial voltages to the common electrode layer of each region of the display panel 100 and measure the initial voltage of the common electrode layer of each region. Then, a first deviation value of the initial voltages of each region from the preset voltage is compared with the preset deviation value, and the initial voltage can be subtracted from the preset voltage to obtain a difference value, the corresponding region as a color shift region is determined when the first deviation value is larger than the preset deviation value, and the timing controller 210 adjusts the initial voltage of the color shift region according to the difference value so as to enable the initial voltage of the color shift region to be equal to the preset voltage. The timing controller 210 determines a second deviation value between the voltage of the sub-pixel corresponding to each sub-pixel in the color shift region and the preset voltage, and looks the gray-scale compensation table up according to the second deviation value to obtain a gray-scale compensation value, where the gray-scale compensation table includes a mapping relation between the second deviation value and the gray-scale compensation value, and the gray-scale compensation table is pre-stored in the storage unit 212 of the timing controller 210. The timing controller 210 compensates the data voltages of the sub-pixels in the color shift region according to the gray-scale compensation value, so that the compensated data voltage is input to the corresponding sub-pixel.

After comparing the first deviation value of the initial voltage of each region from the preset voltage with the preset deviation value, when the first deviation value is smaller than the preset deviation value, the display panel may be displayed normally without compensating the initial voltage of the display panel, or the initial voltage of each region can be adjusted to the identical, for example, the display panel may be displayed normally with the initial voltage of each region of the display panel being adjusted to the preset voltage.

The common electrode layer of the display device described above has a plurality of regions, after determining the color shift region, by coarsely adjusting the initial voltage of the color shift region and compensating the data voltages of sub-pixels in the color shift region, the pulling of the data voltages of the sub-pixels to the common voltage is counteracted, thereby improving the color shift caused by the deviation of the common voltage. Meanwhile, the amplitude of data compensation that needs to be adjusted can be reduced by first coarsely adjusting the initial voltage of the color shift region and then the data voltages of the sub-pixels in the color shift region are finely adjusted, thereby reducing the power consumption of the display panel.

All possible combinations of the technical features in the embodiments described above may not be described for the sake of brevity, but should be considered as being within the scope of the present disclosure as long as there is no contradiction between the combinations of the technical features.

The embodiments described above only describe several implementations of the present application, and the description thereof is specific and detailed. However, those cannot be therefore construed as limiting the scope of the claims. It should be noted that, for those of ordinary skill in the art, several variations and modifications can be made without departing from the concept of the present disclosure, which also fall within the scope of the present disclosure. Therefore, the protection scope of the present application shall be defined by the appended claims.

What is claimed is:

1. A correction method for a display panel, comprising:

dividing a common electrode layer of the display panel into at least one region;

applying a respective initial voltage to each of the at least one region of the common electrode layer, and measuring the respective initial voltages of the at least one region, wherein the initial voltage is a common voltage and the common voltage of each of the at least one region of the common electrode layer is independently controlled;

comparing a first deviation value of each of the respective common voltages of the at least one region shifting from a preset voltage against a preset deviation value, wherein the preset voltage is a voltage of the common electrode layer when the display panel normally displays;

when the first deviation value is larger than the preset deviation value, taking the region corresponding to the first deviation value as a color shift region;

adjusting the common voltage of the color shift region to be equal to the preset voltage;

determining a gray-scale compensation value based on a sub-pixel voltage corresponding to each sub-pixel in the color shift region and the preset voltage; and compensating a data voltage of each sub-pixel in the color shift region according to the respective gray-scale compensation value;

wherein the determining a gray-scale compensation value according to the sub-pixel voltage corresponding to each of the sub-pixels in the color shift region and the preset voltage comprises:

calculating a second deviation value of the sub-pixel voltage corresponding to each sub-pixel in the color deviation region from the preset voltage;

obtaining a gray-scale compensation table comprising a mapping relation between the second deviation value and the gray-scale compensation value; and obtaining the gray-scale compensation value according to the second deviation value.

2. The correction method according to claim 1, wherein the display panel displays normally when each of the first deviation values is smaller than the preset deviation value.

3. The correction method according to claim 1, wherein the initial voltage of each of the regions is adjusted to be identical when each of the first deviation values is smaller than the preset deviation value, and the display panel displays normally.

4. The correction method for a display panel according to claim 1, wherein the adjusting the common voltage of the color shift region to be equal to the preset voltage comprises:

comparing the initial voltage against the preset voltage, and determining the difference value between the initial voltage and the preset voltage; and compensating the initial voltage according to the difference value, so as to enable the initial voltage of the color shift region to reach the preset voltage.

5. The correction method according to claim 1, wherein the applying a respective initial voltage to each of the at least one region of the common electrode layer and measuring the respective initial voltages of the at least one region comprises:

applying a respective initial voltage to each of the at least one region of the common electrode layer, and measuring the respective initial voltages of the at least one region by a timing controller.

6. A correction method for a display panel, comprising:

dividing a common electrode layer of the display panel into at least one region;

applying a respective initial voltage to each of the at least one region of the common electrode layer, and measuring the respective initial voltages of the at least one region, wherein the initial voltage is a common voltage and the common voltage of each of the at least one region of the common electrode layer is independently controlled;

comparing a first deviation value of each of the respective common voltages of the at least one region shifting from a preset voltage against a preset deviation value, wherein the preset voltage is a voltage of the common electrode layer when the display panel normally displays;

when the first deviation value of each of the respective common voltages of the at least one region shifting from the preset voltage is smaller than the preset deviation value, determining that the display panel displays normally;

otherwise when the first deviation value is larger than the preset deviation value, taking the region corresponding to the first deviation value as a color shift region;

adjusting the common voltage of the color shift region to be equal to the preset voltage;

determining a gray-scale compensation value based on a sub-pixel voltage corresponding to each sub-pixel in the color shift region and the preset voltage; and compensating a data voltage of each sub-pixel in the color shift region according to the respective gray-scale compensation value;

wherein the determining a gray-scale compensation value according to the sub-pixel voltage corresponding to each of the sub-pixels in the color shift region and the preset voltage comprises:

calculating a second deviation value of the sub-pixel voltage corresponding to each sub-pixel in the color deviation region from the preset voltage;

obtaining a gray-scale compensation table comprising a mapping relation between the second deviation value and the gray-scale compensation value; and obtaining the gray-scale compensation value according to the second deviation value.

7. The correction method according to claim 6, further comprising the following operation subsequent to the operation of determining that the display panel displays normally when the first deviation value of each of the respective common voltages of the at least one region shifting from the preset voltage is smaller than the preset deviation value:

adjusting the common voltage of each of the at least one to be identical when the first deviation value of each of the respective common voltages of the at least one region shifting from the preset voltage is smaller than the preset deviation value, and then the display panel displays normally.

8. The correction method according to claim 7, wherein the adjusting the common voltage of the color shift region to be equal to the preset voltage comprises:

comparing the initial common voltage against the preset voltage, and determining the difference value between the initial voltage and the preset voltage; and compensating the initial voltage according to the difference value, so as to enable the initial voltage of the color shift region to reach the preset voltage.

9. A display device, comprising:

a display panel configured to display images;

a display control module electrically connected to the display panel, the display control module comprises a timing controller comprising a storage unit, a processing unit and a computer program stored on the storage unit and operable on the processing unit, the program, when executed by the processing unit, implements the steps of:

dividing a common electrode layer of the display panel into at least one region;

applying a respective initial voltage to each of the at least one region of the common electrode layer, and measuring the respective initial voltages of the at least one region, wherein the initial voltage is a common voltage and the common voltage of each of the at least one region of the common electrode layer is independently controlled;

comparing a first deviation value of each of the respective common voltages of the at least one region shifting from a preset voltage against a preset deviation value, wherein the preset voltage is a voltage of the common electrode layer when the display panel normally displays;

when the first deviation value is larger than the preset deviation value, taking the region corresponding to the first deviation value as a color shift region;

adjusting the common voltage of the color shift region to be equal to the preset voltage;

determining a gray-scale compensation value based on a sub-pixel voltage corresponding to each sub-pixel in the color shift region and the preset voltage; and compensating a data voltage of each sub-pixel in the color shift region according to the respective gray-scale compensation value;

wherein the determining a gray-scale compensation value according to the sub-pixel voltage corresponding to each of the sub-pixels in the color shift region and the preset voltage comprises:

calculating a second deviation value of the sub-pixel voltage corresponding to each sub-pixel in the color deviation region from the preset voltage;

obtaining a gray-scale compensation table comprising a mapping relation between the second deviation value and the gray-scale compensation value; and obtaining the gray-scale compensation value according to the second deviation value.

10. The display device according to claim 9, wherein the display panel displays normally when each of the first deviation values is smaller than the preset deviation value.

11. The display device of claim 9, wherein the display device comprises a LCD or an Organic Light Emitting Diode Display.

12. The correction method according to claim 1, wherein the common electrode layer of the display panel is divided into a number of nine regions that are arranged in an array of three times three.

13. The correction method according to claim 1, wherein the gray-scale compensation table is pre-stored in the timing controller, or in an external memory.

14. The correction method according to claim 1, wherein the data voltages of sub-pixels of the display panel have positive and negative polarities, and when the second deviation value of a sub-pixel in the color shift region has a positive polarity, the corresponding gray-scale compensation value for the sub-pixel also has a positive polarity, and when the second deviation value of a sub-pixel in the color shift region has a negative polarity, the corresponding gray-scale compensation value for the sub-pixel also has a negative polarity.

* * * * *